US008653915B2

(12) United States Patent
Schmidt et al.

(10) Patent No.: US 8,653,915 B2
(45) Date of Patent: Feb. 18, 2014

(54) ELECTRICAL CONTACTOR

(75) Inventors: Stephen M. Schmidt, Menomonee Falls, WI (US); Dennis A. Maller, Racine, WI (US)

(73) Assignee: Trumpet Holdings, Inc., Milwaukee, WI (US)

( * ) Notice: Subject to any disclaimer, the term of this patent is extended or adjusted under 35 U.S.C. 154(b) by 178 days.

(21) Appl. No.: 13/282,099

(22) Filed: Oct. 26, 2011

(65) Prior Publication Data

US 2013/0106544 A1 May 2, 2013

(51) Int. Cl.
*H01H 3/00* (2006.01)
*H01H 51/22* (2006.01)

(52) U.S. Cl.
USPC ..... 335/185; 335/78

(58) Field of Classification Search
USPC ..... 335/78, 128–133, 185–187, 189
See application file for complete search history.

(56) References Cited

U.S. PATENT DOCUMENTS 5,416,455 A * 5/1995 Moldovan et al. ..... 335/132
6,292,075 B1 * 9/2001 Connell et al. ..... 335/185
8,222,981 B1 * 7/2012 Zarbock et al. ..... 335/128
2009/0206965 A1 * 8/2009 Niimi ..... 335/106
2012/0162847 A1 * 6/2012 Suzuki et al. ..... 361/206
2012/0242431 A1 * 9/2012 Nawa ..... 335/185

OTHER PUBLICATIONS

Data Sheet, American Zettler. Inc., AZ983; 80 AMP Mini-Iso Automotive Relay, Jul. 29, 2011, 2 pages.
Data Sheet, American Zettler, Inc., AZ2510: 100 AMP Latching Power Relay, Jun. 4, 2009, 2 pages.
Data Sheet, Tyco Electronics Corporation, High Current Relay 150, 2011, 3 pages.

* cited by examiner

*Primary Examiner* — Bernard Rojas
(74) *Attorney, Agent, or Firm* — Ryan Kromholz & Manion, S.C.

(57) ABSTRACT

An embodiment of an electrical contactor according to the present invention provides improved operability and manufacturability. Such electrical contactor may include a housing substantially surrounding an electrical conductor assembly and contact actuator. The conductor assembly includes a stationary contact assembly and a movable contact assembly. The contact actuator selectively mechanically interfaces to the movable contact assembly to make or break an electrical conduction. The contactor provides improved contact bounce dampening and actuator force characteristics. Methods according to the present invention include a method of manufacturing and a method of operating a solenoid actuated electrical contactor so as to minimize solenoid plunger acceleration and impact forces while making the electrical conduction and to maximize solenoid plunger acceleration and impact forces while breaking the electrical conduction.

25 Claims, 9 Drawing Sheets

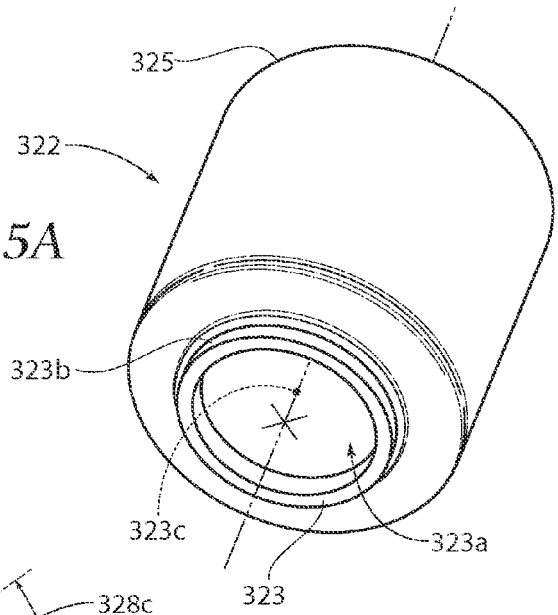
Fig. 5A
Fig. 5B
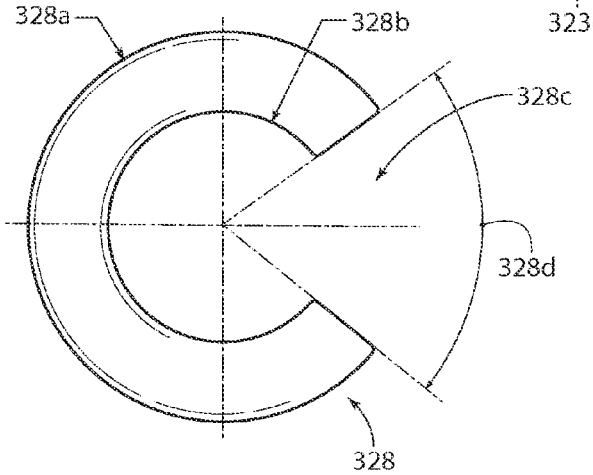
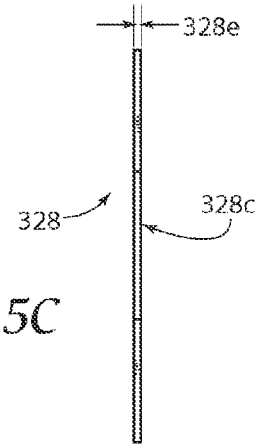
Fig. 5C
Fig. 6
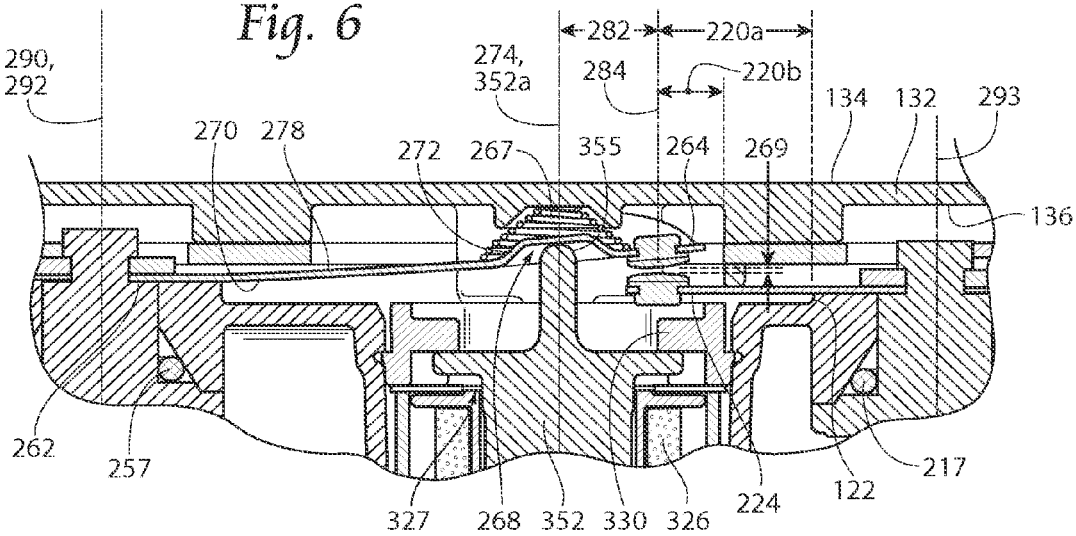

ELECTRICAL CONTACTOR

BACKGROUND OF THE INVENTION

The present invention relates generally to the field of electricity switching, and more particularly to high current capacity electrical contactors.

Such contactors generally comprise a high current switch with two or more electrically conductive contacts, at least one of which is movable. When the contacts touch or close an electrical communication path is established through which high electrical currents may flow. A contactor furthermore generally comprises an actuator, which is typically of a solenoid type with a wound coil. The actuator serves to influence the position of the movable contact. As such, a relatively small amount of electrical power applied to the solenoid coil can influence the movable contact to touch/close or separate/open from the other contact(s). Most typical high current electrical contactors are configured such that when the solenoid actuator member is deactivated, the contacts are open. This is commonly referred to as a normally open (NO) contactor.

Generally, the contacts of a NO contactor can be structured to either permissively make or be forced to make an electrical connection between one or more terminals through which high current may flow. In either of these structures, the coil must be activated to establish electrical communication between two or more high current terminals. Stated conversely, in both structures, when the coil is deactivated, or in its free state, the provided terminals are separated and are not in electrical communication.

The distinction between a NO contactor of the permissive-make configuration and one of the forced make configuration is generally not evident from external observation nor simply through observing electrical switching behavior, because either configuration will close upon activation. Upon internal examination, however, the types can be distinguished based upon the relation between the mechanical engagement of the actuator with the movable contact and the electrically communicative engagement of the contacts. In a permissive-make NO contactor, the contacts are under a bias that will cause them to close or make contact when separated from the actuator portion of the contactor. In other words, activation of the contactor allows or permits the contacts to close under the bias force. Conversely, the contacts open when the movable contact is mechanically engaged by the actuator. In contrast, in a forced make NO contactor, the contacts are under a bias that will cause them to be open when separated from the actuator or when the actuator is deactivated. Conversely, the contacts close when the movable contact is mechanically engaged by the actuator. In other words, activation of the contactor forces the contacts to close under the mechanical engagement of the actuator with the movable contact, overcoming the biasing force.

Thus, a permissive-make contactor generally refers to a contactor that must be activated to make or achieve an electrical coupling between two or more terminals. Stated conversely, when a permissive-make contactor is deactivated, or in its free state, the provided terminals are in electrical isolation.

It is a well known problem that the contacts of electromagnetically activated contactors undergo severe stresses during use. For example, when current carrying contacts are separated, electrical arcing is likely to occur, thereby decreasing the life of the contacts by wearing the contact surfaces. Therefore, sufficient force must be used in separating the contacts so that the arcing is minimized in time. That is, the less time the arc exists, the less wear on the contacts per switching cycle. In permissive-make contactors, the separation of current carrying contacts is achieved largely by a biasing member, and the force applied to the movable contact is directly related to same. Thus, to achieve a fast break of the electrical communication, a sufficiently forceful biasing mechanism must be used. Conversely, when separated contacts are engaged, the contacts have been known to bounce, thus creating an arc and leading to further wear on the contacts. Contact bouncing is the leading cause of break arc, and it may even lead to hard destructive welding of the electrical contacts under certain conditions.

Therefore, the art of electrical contactors would benefit from a device that exhibits improved electrical communication making and/or breaking actions.

SUMMARY OF INVENTION

Embodiments of the present invention include electrical contactor systems and methods of manufacture that exhibit improved electrical communication making and/or breaking actions.

One embodiment of an electrical contact according to the present invention includes a housing and an electrical conductor assembly at least partially within the housing. The electrical conductor assembly includes a stationary contact assembly and a movable contact assembly. Also included is a contact actuator operably interfaced with the electrical conductor assembly. The contact actuator includes a plunger movable from a first plunger position in contact with the movable contact assembly to a second plunger position spaced from the movable contact assembly, wherein translation of the plunger is preferably limited by a stop flange provided on the plunger. The stationary contact assembly defines a first electrically conductive path from a first electrical contact to a first terminal, where the first electrical contact located within the housing and the first terminal is accessible external the housing, preferably extending through the housing. The movable contact assembly defines a second electrically conductive path from a second electrical contact to a second terminal, the second electrical contact located within the housing and the second terminal is accessible external the housing, preferably extending through the housing. The first electrical contact is preferably arranged between the second electrical contact and a portion of the plunger. When the plunger is in the second plunger position, a third electrically conductive path is preferably defined from the first terminal to the second terminal.

One aspect of an embodiment of an electrical conductor according to the present invention includes a housing comprising a shroud wall defining a cavity, a cover mateable with the shroud wall along a seam and a waterproof gasket disposed between the shroud wall and the cover.

Another aspect of an embodiment of an electrical conductor according to the present invention includes an electromagnetic solenoid assembly. The assembly may include a movable plunger assembly comprising the plunger extending between a first contact end and a second bobbin end, and a plunger biasing mechanism configured to bias the plunger towards the movable contact assembly. The solenoid assembly may further include a stationary coil assembly comprising a substantially cylindrical can having an open washer end, a bobbin situated substantially within the can, a plurality of turns of electrical conductor disposed around the bobbin, and a magnetically permeable cover washer, which may be C-shaped, configured to rest against the open washer end. A retention mechanism is preferably provided which is configured to maintain the stationary coil assembly in a substantially stable relationship with the housing. Where a retention mechanism is provided, the plunger stop flange may rest against it when the plunger is in the first plunger position and the stop flange may rest against the cover washer when in the second plunger position. An example of a retention mechanism is a retention ring adapted to contact the housing and the cover washer. The retention mechanism may further include a resilient biasing member, such as a nitrile o-ring, compressed between the can and the housing, wherein the biasing member forces the can towards the cover washer.

When the electromagnetic solenoid assembly is de-energized, the plunger biasing mechanism may force the plunger contact end against the second contact member thereby causing the second contact to disengage from the first contact. When the electromagnetic solenoid assembly is energized, the second electrical contact may be allowed to travel toward and engage with the first electrical contact.

The plunger may include a reentrant bore formed into the second bobbin end and the plunger biasing mechanism is a coiled spring inserted at least partially into the reentrant bore.

Still another aspect of an embodiment of an electrical conductor according to the present invention includes a movable contact assembly having an electrically conductive contact bar supporting the second contact and a contact bias member, which may be a coiled, frutoconical spring, disposed between the contact bar and the housing, the contact bias member applying force to the contact bar to bias the second contact towards the first contact. The spring member may include a base coil lying circumjacent to a protrusion formed on the contact bar. Such protrusion may be formed by a dimple integrally disposed with the contact bar.

An embodiment of a method according to the present invention provides a method of allowing an electrical connection to be made between two electrically conductive terminals. The method includes the step of providing a contact actuator operably interfaced with an electrical conductor assembly having a first electrical contact and a second electrical contact. The first electrical contact may be provided on a stationary contact assembly comprising a first cantilevered electrically conductive contact bar extending between a mounting end and free end, the first electrical contact provided closer to the free end than the mounting end. The second electrical contact may be provided on a movable contact assembly comprising a second cantilevered electrically conductive contact bar extending between a mounting end and free end that at least partially overlaps the free end of the first contact bar, the second electrical contact provided closer to the free end than the mounting end. The first and second contact bars may be provided of different lengths. For instance, the first contact bar may be shorter in length than the second contact bar. The movable contact assembly may further include a contact bias member disposed between the contact bar and the housing, the contact bias member applying force to the contact bar to bias the second contact towards the first contact. The contact actuator includes a plunger and a stationary coil assembly. The plunger is movable from a first plunger position in contact with a movable contact assembly to a second plunger position spaced from a movable contact assembly, wherein translation of the plunger is limited by a stop flange provided thereon. The stationary coil assembly includes a substantially cylindrical can having an open washer end, a bobbin situated substantially within the can, a plurality of turns of electrical conductor disposed around the bobbin, and a magnetically permeable cover washer configured to rest against the open washer end. The method further includes the step of placing a voltage differential across the electrical conductor to draw the stop flange towards the cover washer. Also, the method includes the step of controlling a terminal velocity of the plunger by substantially magnetically saturating the cover washer with a magnetic field caused by electrical current flow through the electrical conductor. After the cover washer is substantially magnetically saturated, the plunger is allowed to reach a mechanical end of travel in the second plunger position.

The mechanical end of travel may be defined by seating the stop flange against the cover washer so as to space the plunger from the movable contact assembly. When the plunger is at its mechanical end of travel in the second position, e.g., seated against the cover washer, and the second contact is engaged with the first contact, the first contact bar is preferably deflected by a force exerted on the first contact by the second contact.

When the plunger is in the first plunger position, the plunger preferably abuts the second contact bar at a contact area between the second contact and the mounting end of the second contact bar. The contact area is preferably closer to the free end of the second contact bar and closer to the second contact than the contact area is with respect to the mounting end of the second contact bar.

A method according to the present invention may include the steps of removing the voltage differential from the electrical conductor, forcing the plunger towards the second contact bar. The second contact bar may then be struck with the plunger after allowing the plunger to travel some distance spaced from the second contact bar, thereafter separating the second electrical contact from the first electrical contact. The separation of the second electrical contact from the first electrical contact may involve the step of breaking a weld formed between the first electrical contact and the second electrical contact.

Another embodiment of an electrical contactor according to the present invention has a solenoid assembly including a movable plunger assembly and a stationary coil assembly. The movable plunger assembly includes a plunger extending between a first contact end and a second bobbin end. The plunger is longitudinally movable from a first plunger position in contact with a movable contact assembly to a second plunger position spaced from the movable contact assembly, wherein translation of the plunger is limited by a stop flange provided on or coupled to the plunger. The stationary coil assembly includes a substantially cylindrical can extending between an open washer end and a bobbin end. An aperture is preferably formed through the bobbin end and a collar is disposed around the aperture. A bobbin is situated substantially within the can, and turns of electrical conductor are disposed around the bobbin. The bobbin end of the plunger preferably extends into, and is slidable within, the aperture. The bobbin end of the plunger may extend into the aperture when the plunger is in either the first plunger position or the second plunger position. A magnetically permeable cover washer may be configured to rest against the open washer end.

BRIEF DESCRIPTION OF THE DRAWINGS

FIG. 5A is a perspective view of a solenoid can according to the present invention.

FIG. 5B is a top plan view of a cover washer according to the present invention.

FIG. 5C is a right side elevation view of the cover washer of FIG. 5B.

FIG. 6 is a partial cross-section view of FIG. 5.

DESCRIPTION OF THE PREFERRED EMBODIMENT

Figure 1:
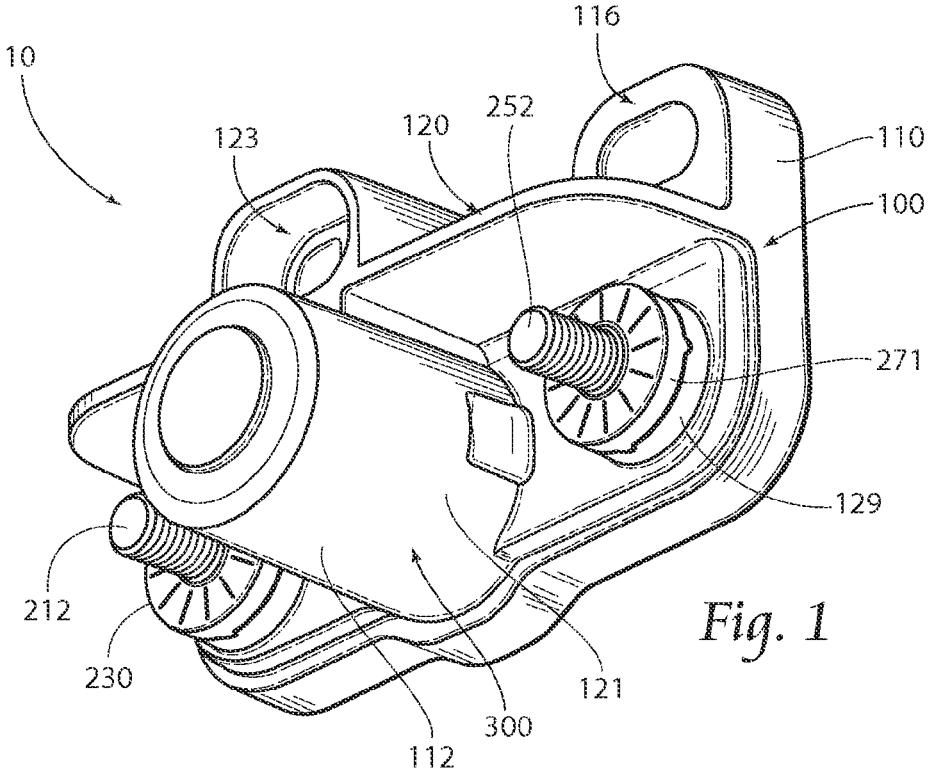
FIG. 1 provides a perspective view of an embodiment of an electrical contactor according to the present invention.
Figure 2:
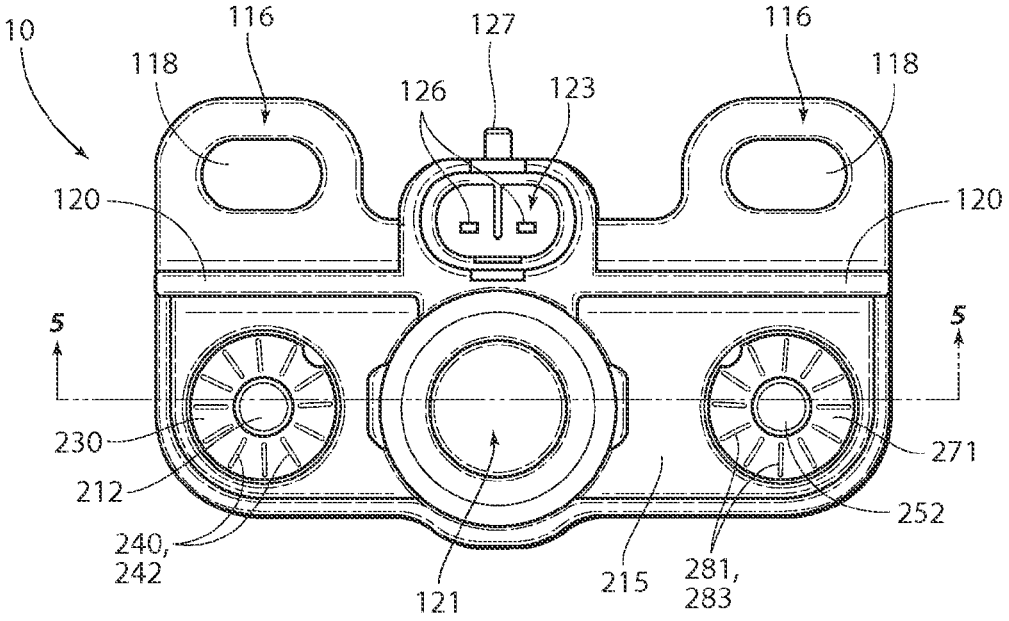
FIG. 2 is a front elevation view of the embodiment of FIG. 1.
Figure 3:
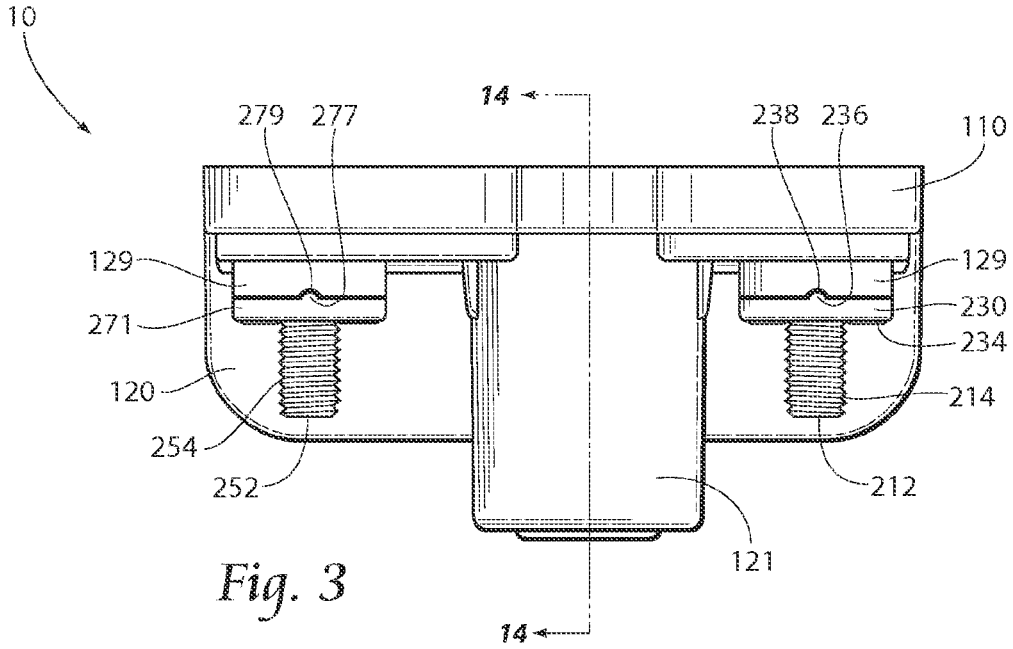
FIG. 3 is a bottom plan view of the embodiment of FIG. 1.
Figure 4:
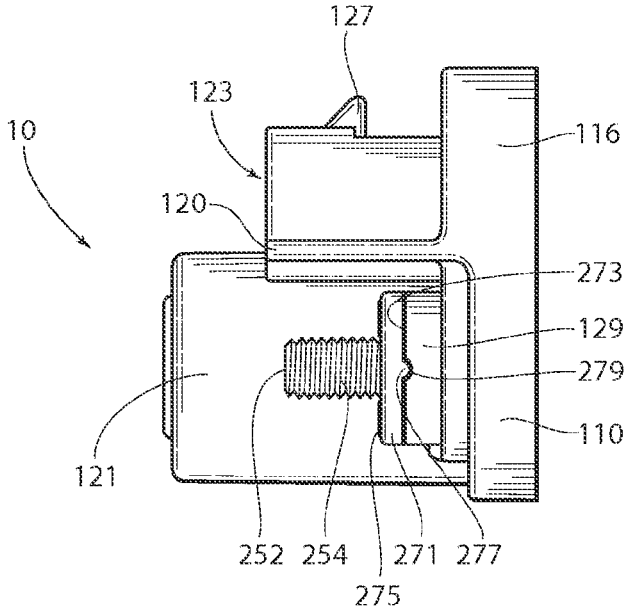
FIG. 4 is a right side elevation view of the embodiment of FIG. 1.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Turning now to the figures, FIGS. 1-5 provide a first embodiment 10 of an electrical contactor according to the present invention. The contactor 10 generally includes a housing 100, an electrical conductor assembly 200 situated at least partially within the housing 100, and a contact actuator 300 operably interfaced with the electrical conductor assembly 200. The housing 100 preferably includes a shroud 110 and a cover 130 mateable with the shroud 110. The shroud 110 includes a shroud wall 112 extending preferably completely around and defining a cavity 114. The shroud wall 112 may be formed with a substantially planar front surface 115. Coupled to or formed integrally with the shroud wall 112 may be a mounting flange 116 including one or more mounting apertures 118 formed therethrough. Also coupled to or formed integrally with the shroud wall 112 may be a terminal insulator 120. The terminal insulator 120 may extend outwardly from the shroud wall 112, and may be arranged at least substantially perpendicular to the front surface 115 thereof. The shroud wall 112 preferably includes an actuator portion 121 and a control socket 123. The actuator portion 121 may generally define an actuator cavity 125. The control socket 123 is a cavity that is preferably accessible from outside the housing 100, enabling electrical connection of actuation control conductors 126 to associated conductors in a corresponding plug (not shown) adapted to matingly engage the control socket 123. Attached to or formed integrally with the shroud wall 112 may be a plug retainer 127 adapted to receive and retain a retainer clip (not shown) provided on the corresponding plug (not shown).

The cover 130 includes a cover wall 132 which is preferably adapted to be positioned within the cavity 114. The cover 130 has an outer surface 134 and an oppositely disposed inner surface 136. The outer surface 134 is preferably formed in a substantially planar orientation, but may be customized, possibly in cooperation with the mounting flanges 116 and apertures 118, to mate with a predetermined mounting surface (not shown). The cover 130 outer surface 134 is preferably fluid impervious. About the perimeter of the cover 130 are disposed a plurality of male clip portions 138, adapted to engage the shroud wall 112. The male clip portions 138 preferably include a male clip engagement surface 138*a* adapted to mate with a female clip engagement surface 139*a* provided on the shroud wall 112.

Coupled to, extending from and/or formed integrally with the cover inner surface 136, in addition to optional reinforcing ribs 140, are a few features that will be explained in more detail below: a spring registration element 142, an optional stationary-contact limit peg 144, and at least one, but preferably a pair of retention tabs 146. The spring registration element 142 is provided on the inner surface 136 of the cover 130. The registration element 142 is preferably formed as an annular wall 142*a* formed about a spring axis 143. The annular wall 142 preferably includes a frustoconical inner surface 142*b*. While shown as a continuous annular surface, the registration element 142 may be provided as intermittent wall portions, or even a peg about which a spring may rest. The stationary-contact limit peg 144, or an extension thereof or attachment thereto, if provided, may extend preferably at least substantially perpendicular to the inner surface 136 for a predetermined limit distance 145 relative to the male clip engagement surface 138*a*, or a predetermined distance relative to another reference index relatable to the housing shroud wall 112. The limit peg 144 may be spaced from or, as shown, formed integrally with one or more of the reinforcement ribs 140. Alternatively, the limit peg 144 may not even be used, in which case the resiliency of the stationary contact bar 220, as described below, may be relied upon for adequate making and breaking of electrical conduction. Also extending inwardly from the cover inner surface 136 are the one or more retention tabs 146, if provided. Preferably a pair of retention tabs 146 is provided, which may be diametrically opposed relative to the spring axis 143. Each retention tab 146 has at least one ring engagement surface 146*a* and an optional piston engagement surface 146*b*. Preferably, each tab 146 is formed as a planar plate extending across a tab width 147. A ring engagement surface 146*a* may be provided on either side of the piston engagement surface 146*b*. The ring engagement surface 146*a* is provided at a first distance 148 relative to the male clip engagement surface 138*a*, or a predetermined distance relative to another reference index relatable to the housing shroud wall 112. The piston engagement surface 146*b* is provided at a second distance 149 relative to the male clip engagement surface 138*a*, or a predetermined distance relative to another reference index relatable to the housing shroud wall 112. The second distance 149 is preferably greater than the first distance 148, thus causing the piston engagement surface 146*b* to be disposed at a greater distance from the inner surface 136 of the cover 130 than the ring engagement surface 146*a*, or causing the piston engagement surface 146*b* to extend further into the cavity 114 when the device 10 is assembled. Additionally or alternatively, if both the ring engagement surface

146*a* and the piston engagement surface 146*b* are provided, they may be provided at a predetermined ring spacing 149*a* relative to one another.

The tabs 146 need not be used at all, but as will be explained later, the ring engagement surface 146*a* and the piston engagement surface 146*b* may provide desired stability and longevity. A bobbin registration fin 155 may also be provided, preferably as coupled to or formed integrally as an extension of one of the reinforcing ribs 140. As described The base 110 and the cover 130 are preferably adapted to be coupled together along a seam 150, which may be sealed by a gasket 152 disposed between a portion of the shroud 110 and a portion of the cover 130. The coupling of the shroud 110 and the cover 130 may be by any desirable means such as by locking or frictional engagement with clip mechanisms 154, as shown, or by other means such as other frictional engagement, adhesive, ultrasonic welding, etc. Where clip mechanisms 154 are utilized, a female clip portion 139 is preferably formed into the shroud wall 112, including a female clip engagement surface 139*a* adapted to mate with the male clip engagement surface 138*a* provided on the cover 130. The female clip engagement surface 139*a* may serve as a first index point with respect to positioning of various components within the housing 100.

Although other materials may work, the cover 130 is preferably formed from a thermosetting phenolic resin material. The shroud 110 is preferably formed from a reinforced nylon material, such as a nylon 6,6 material, which may be reinforced with glass fiber, such as the material Vydyne R533H available from Ascend Performance Materials, LLC of Houston, Tex., which includes about 33 percent by weight of such glass or glass mixture. Although other electrically conductive materials may work, the actuation control conductors 126 are preferably formed from tin plated brass sheet material. Although other waterproof materials may work, the gasket 152 is preferably formed from a chlorosulfonated polyethylene material, such as that sold under the Hypalon® trademark by DuPont Performance Elastomers of Wilmington, Del., or a nitrile rubber (or Buna-N), having a desirable consistency, such as about 55 durometer on the Shore A scale.

Figure 5:
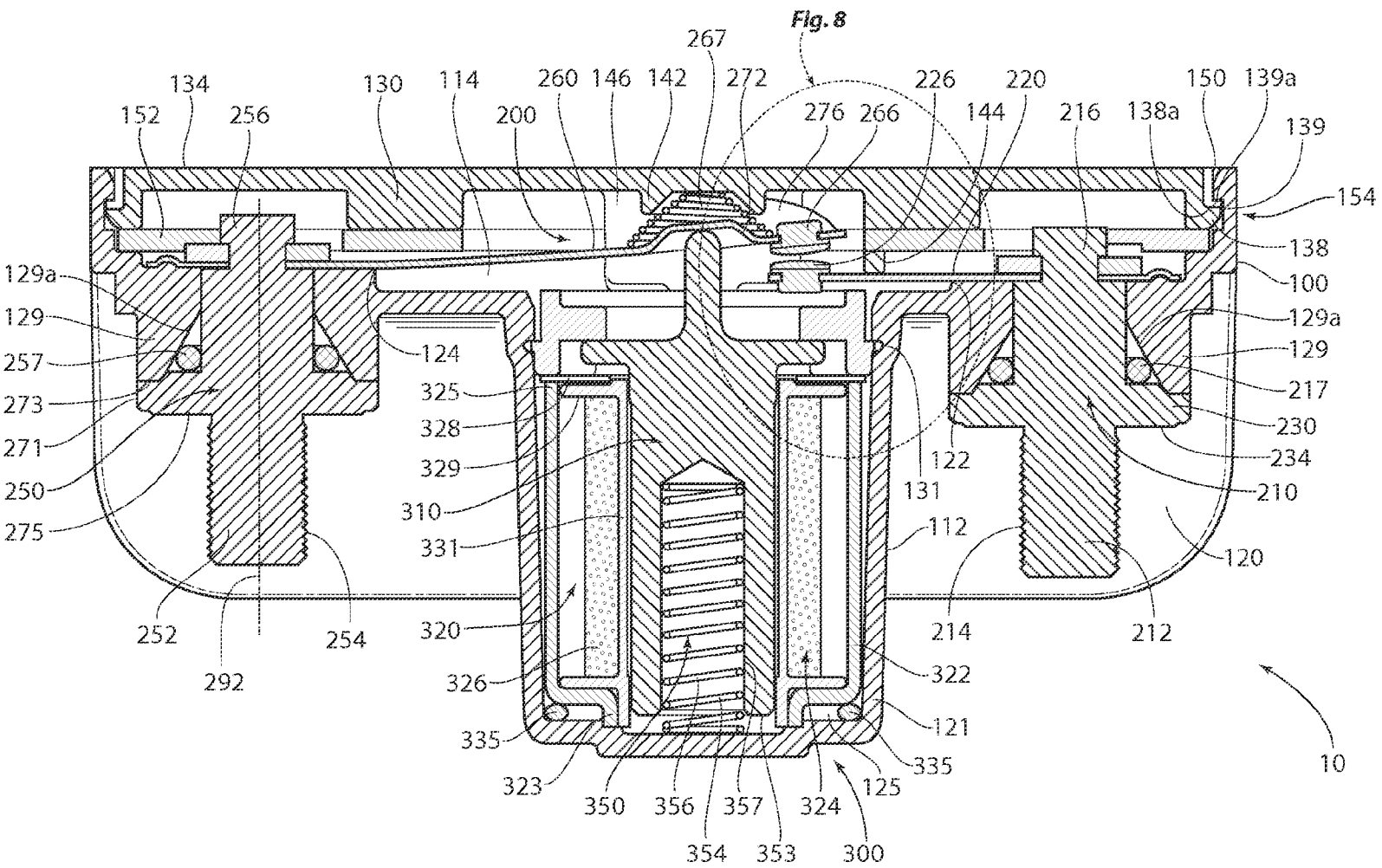
FIG. 5 is a cross-sectional view taken along line 5-5 of FIG. 2.
Figure 7:
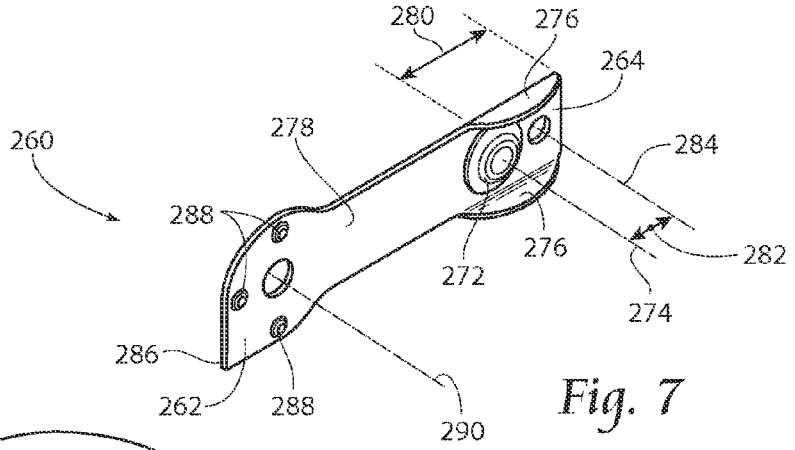
FIG. 7 is a perspective view of an embodiment of a movable contact arm according to the present invention.

The electrical conductor assembly 200, which can be further seen in FIGS. 5-6, generally includes a stationary contact assembly 210 and a movable contact assembly 250. Although the terms stationary and movable have been chosen for general relative reference, the terms are not absolute, nor do they literally describe each and every portion of the respective assemblies. The stationary contact assembly 210 generally includes a first terminal 212 adapted to be electrically accessible outside of the housing 100. The first terminal 212 may be provided with threads 214 along a length thereof, and a first terminal rivet or flange 216 at an end thereof. The first terminal flange 216 is adapted to extend into the housing 100, preferably through a tapered aperture 129*a* formed in the shroud wall 112, and electrically couple a portion of the stationary contact assembly 210 to the first terminal 212. A first terminal gasket 217, such as a nitrile O-ring, preferably about 70 durometer, may be arranged around the first terminal 212 and between the first terminal 212 and the housing 100. The threads 214 may provide a mechanical anchor point for an electrical conductor (not shown).

The stationary contact assembly 210 also includes a stationary contact bar 220 mounted within the housing 110. The stationary contact bar 220 may include a mounting portion 222 and a free end 224, the mounting portion 222 adapted to be coupled to the first terminal 212 and the free end 224 coupled to or formed integrally with the mounting end 222 and adapted to support a first electrical contact 226. The stationary contact bar 220 is preferably adapted to be positioned in an at least partially overlapping relationship to a dampening stud 122 which may be formed integrally as a portion of the housing base 110.

Disposed about and/or formed integrally with the first terminal 212 is a contact plate 230. The contact plate 230 is preferably formed as a substantially planar disc in a coaxial relationship to the terminal 212 about a terminal axis 293. The contact plate 230 preferably includes a mounting surface 232 and a terminal surface 234. The mounting surface 232 is adapted to mate to a portion of the shroud 110, perhaps at a terminal abutment 129 formed in the shroud wall 112. The mounting surface 232 preferably includes one or more rotational registration elements, such as male or female bumps or grooves 236, which are adapted to cooperate with one or more at least partially mating rotational registration elements, such as female or male grooves or bumps 238, respectively, provided on the terminal abutment 129. The terminal surface 234 may include a plurality of frictional elements 240, such as radially extending ribs 242 which may be formed substantially as a triangular prism. When the term prism is used, it is to be understood that the term encompasses the geometric shape of a prism and does not necessarily require the material forming the shape to be optically transparent or translucent. The frictional elements 240 may prove advantageous to help prevent rotation of a connector lug (not shown) which may be inserted over the terminal 212. The lug (not shown) may be forced to cooperate with the frictional elements 240 by, e.g., a threaded nut (not shown) cooperating with the terminal threads 214.

While various electrically conductive materials may work, the first terminal 212 is preferably formed from a desirable copper alloy, such as a drawn rod of C11000 or C10200. The first terminal 212 may instead be formed from a solid copper cold headed rivet, or may be a mild steel rivet. The stationary contact bar 220 is preferably formed from solid copper, preferably half-hard copper, of a desired thickness, such as between about 0.010 inches and about 0.050 inches, and more preferably about 0.015 inches. The first contact 226 is preferably formed from a silver tin oxide material, or include such material deposited on or coupled to a stem of other material, such as copper.

The movable contact assembly 250 generally includes a second terminal 252 adapted to be electrically accessible outside of the housing 100. The second terminal 252 may be provided with threads 254 along a length thereof, and a second terminal rivet or flange 256 at an end thereof. The second terminal flange 256 is adapted to extend into the housing 110, preferably through a tapered aperture 129*a* formed in the shroud wall 112, and electrically couple a portion of the movable contact assembly 250 to the second terminal 252. A second terminal gasket 257, such as a nitrile O-ring, preferably about 70 durometer, may be arranged between the second terminal 252 and the housing 100. The threads 254 may provide a mechanical anchor point for an electrical conductor (not shown). The movable contact assembly 250 also includes a movable contact bar 260 mounted within the housing 100. The movable contact bar 260, generally in the form of a leaf spring, whose spring constant effect is preferably negligible as described below. Closer to the first end 262 than the second end 264, the movable contact bar 260 is adapted to be coupled to the second terminal 212. Closer to the second end 264 than the first end 262, the movable contact bar 260 is adapted to support a second electrical contact 266.

Provided between the second electrical contact 266 and the first end 262, the movable contact bar 260 defines an actuator contact area 268 provided on an actuation surface 270 of the bar 260. While the actuator contact area 268 could be provided simply as a location on the otherwise generally planar movable contact bar 260, the contact area 268 is preferably indented, perhaps provided by a frustoconical dimple 272, which is preferably laterally centered on the bar 260, and formed about a dimple axis 274. The dimple 272 may protrude through to a bias surface 278 of the bar 260 to provide a registration location for a movable-contact bias spring 267, which may be situated at one end against the bias surface 278 substantially circumjacent the dimple 272, and at the other end against the inner surface 136 of the cover 130, such as within the spring registration element 142. The bias spring 267 may be a coiled wire conical spring that provides an added benefit of being collapsible on itself. Such conical spring 267 may be formed from any desirable material that will provide desired spring characteristics, such as 302 stainless steel wire having a diameter of preferably about 0.015 to about 0.025 inches, and more preferably about 0.019 inches, with 6.5 total coiled turns and 4.5 active turns, having a spring constant of about two to about 2.5 pounds per inch, and more preferably about 2.275 pounds per inch. The spring 267 preferably has a free (uncompressed and unstretched) length of about 0.41 inches, and more preferably about 0.4089 inches. The working range of the spring 267 is preferably between about 0.07 inches (when plunger 352 is at full stroke as described below) and about 0.1 inches (when plunger 352 is at zero stroke or in overtravel as described below), and more preferably between about 0.0765 inches (when plunger 352 is at full stroke as described below) and about 0.0896 inches (when plunger 352 is at zero stroke or in overtravel as described below).

Also provided near the second free end 264 are one or more reinforcing fins 276 which may be substantially parallel to each other, extending obliquely from a bias surface 278 of the bar 260, the bias surface 278 being disposed on the opposite side of the bar 260 from the actuation surface 270. The reinforcing fins 276 preferably extend along a fin length 280, which spans a distance 282 between a mounting axis 284 of the second electrical contact 266, and the dimple axis 274.

Provided near or at the first end 262 of the movable contact bar 260 are various features aiding in the assembly of the contactor 10. First, the shape of the bar 260, itself, may aid in assembly. For example, a single corner index 286 may be formed. Alternatively, a plurality of laterally asymmetric corner indices 286 could be used. Thus, if the shroud wall 112, or feature thereof, is adapted to lie substantially circumjacent about the first end 262 of the bar 260, the corner index 286 would prevent proper alignment if the bar 260 was inserted into the shroud 110 upside down. Thus, an indicator of right-side-up insertion is provided. Second, one or more registration dimples 288 may be provided. The registration dimples 288 may be used as male or female features adapted to mate with opposite sex dimples or bumps (not shown) formed in a desired orientation on or in the shroud 110. Thus, rotational registration about a mounting axis 290 is provided. When assembled, the mounting axis 290 may generally be aligned with the longitudinal axis 292 about which the second terminal 252 is formed.

Disposed about and/or formed integrally with the first terminal 252 is a contact plate 271. The contact plate 271 is preferably formed as a substantially planar disc in a coaxial relationship to the terminal 212 about a terminal axis 292. The contact plate 271 preferably includes a mounting surface 273 and a terminal surface 275. The mounting surface 273 is adapted to mate to a portion of the shroud 110, perhaps at a terminal abutment 129 formed in the shroud wall 112. The mounting surface 273 preferably includes one or more rotational registration elements, such as male or female bumps or grooves 277, which are adapted to cooperate with one or more at least partially mating rotational registration elements, such as female or male grooves or bumps 279, respectively, provided on the terminal abutment 129. The terminal surface 275 may include a plurality of frictional elements 281, such as radially extending ribs 283 which may be formed substantially as a triangular prism. When the term prism is used, it is to be understood that the term encompasses the geometric shape of a prism and does not necessarily require the material forming the shape to be optically transparent or translucent. The frictional elements 281 may prove advantageous to help prevent rotation of a connector lug (not shown) which may be inserted over the terminal 252.

The lug (not shown) may be forced to cooperate with the frictional elements 281 by, e.g., a threaded nut (not shown) cooperating with the terminal threads 254.

While various electrically conductive materials may work for the various conductive elements, the second terminal 252 is preferably formed from a desirable copper alloy, such as a drawn rod of C11000 or C10200. The second terminal 252 may instead be formed from a solid copper cold headed rivet, or may be a mild steel rivet. The movable contact bar 260 is preferably formed as an at least substantially flat member, from a spring temper, preferably electrically conductive, material such as copper (preferably half-hard) or copper alloy material of a preferred thickness, such as between about 0.010 inches and about 0.050 inches, and more preferably about 0.015 inches. Alternate materials for the movable contact bar 260 may include spring temper steel, spring temper phosphor bronze and other spring temper copper alloys. If additional current carrying capacity is required or desired, a moveable contact copper braid (not shown) may be provided in parallel with the movable contact bar 260. The second contact 266 is preferably formed from a silver tin oxide material. It has been discovered that using silver alloy contacts 226,266 is believed to reduce the amount of force required to maintain electrical communication during high current conditions.

The contact actuator 300 preferably comprises an electromagnetic solenoid assembly 310, including a stationary coil assembly 320 and a movable plunger assembly 350. The stationary coil assembly 320 includes a deep drawn can 322, a bobbin 324 situated substantially within the can 322, a plurality of turns of electrical conductor 326 disposed around the bobbin 324, and a cover washer 328, adapted to retain the bobbin 324 in the can 322. The can 322 is preferably generally formed in a cylindrical shape extending between and including a bias end 323 and an open washer end 325. As can be seen in FIG. 5A, the bias end 323 has an aperture 323*a* formed therethrough. The aperture 323*a* is configured to slidably receive the bobbin end 353 of the plunger 352, which is described below, or a portion of the bobbin 324 in which the bobbin end 353 of the plunger 352 is slidably disposed. The aperture 323*a* is preferably surrounded by a flux collar 323*b*, which is preferably formed integrally with the can 322. The aperture 323*a* is preferably similar in shape to a lateral cross-section of the plunger bobbin end 323, such as circular. The aperture 323*a* is preferably formed about an axis 323*c*, which is preferably coaxially aligned with the plunger axis 352*a* when the solenoid assembly 310 is operable. Thus, it is preferable if no material which forms a part of the magnetic circuit of the stationary coil assembly 320 lies in an intersecting relationship with the plunger axis 352*a*.

The bobbin 324 is generally a continuous U-shape formed about a longitudinal bobbin axis 324*a*, thereby forming bobbin flanges 329 spaced along a bobbin core 331. The electrical conductor 326 is wound around the bobbin core 331, a majority of the conductor 326 lying between the flanges 329, and the bobbin 324 is inserted into the can 322 through the open washer end 325. The cover washer 328 closes off the open washer end 325 and provides a portion of a magnetic circuit of the solenoid assembly 310. The cover washer 328 is preferably formed as a substantially flat toroid, annularly disposed about a plunger aperture 327. FIGS. 5B and 5C depict an embodiment of a cover washer 328 according to the present invention. This embodiment 328 includes an outer diameter 328*a*, an inner diameter 328*b*, a hardware gap 328*c* formed through a gap angle 328*d*, and a washer thickness 328*e*. A preferred outer diameter 328*a* is selected so as to be equal to, or slightly greater than, the diameter of the open end 325 of the can 322. A preferred inner diameter 328*b* is selected so as to be slightly larger than the diameter of the portion of the plunger 352 that travels therethrough. The hardware gap 328*c*, which may not be desired or required, may be provided to accommodate passage of hardware, such as electrical connection hardware for the electrical conductor 326. A preferred hardware gap 328*c* extends through a gap angle 328*d* of about 60 degrees to about 90 degrees, and more preferably about 75 degrees. A preferred washer thickness 328*e* may be selected depending upon the magnetic properties desirable for the magnetic circuit of the solenoid, but a thickness of about 0.014 inches to about 0.016 inches has been shown to be sufficient. The cover washer 328 is preferably formed from a steel strip material, such as by stamping, and may be plated, such as with tin, if desired. When positioned in place for use, the cover washer 328 is preferably mechanically interfaced by being sandwiched between the retention ring 330 and the can 322. Accordingly, if a hardware gap 328*c* is provided, the gap 328*c* is preferably oriented in a way so as not to interfere with such mechanical interface. In a preferred embodiment, the gap 328*c* may be radially aligned below one of the concave sections 336 of the retention ring 330.

Figure 9:
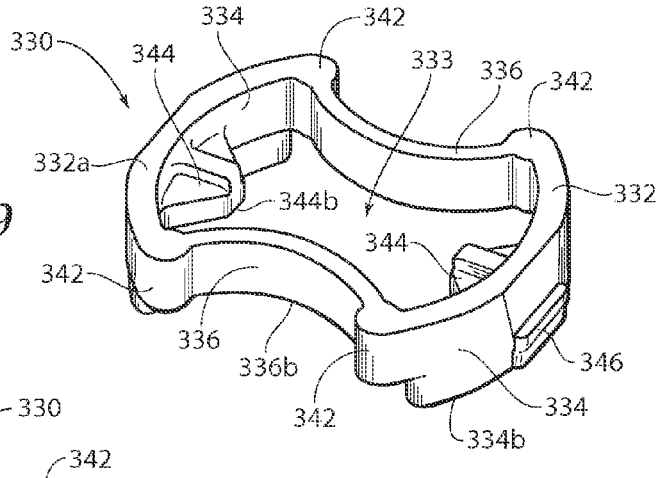
FIG. 9 is a perspective view of an embodiment of an actuator lock ring according to the present invention.
Figure 10A:
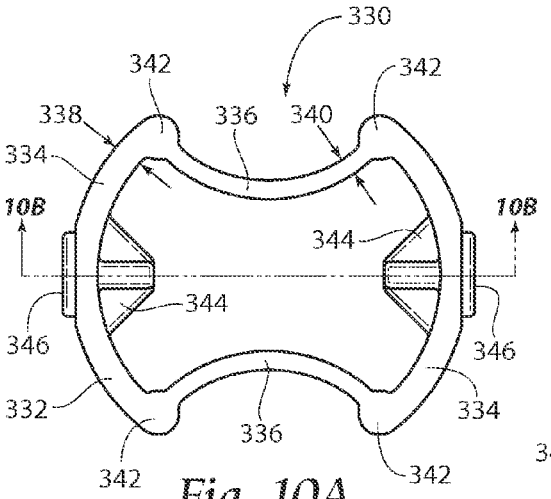
FIG. 10A is a top plan view of the lock ring of FIG. 9.
Figure 10B:
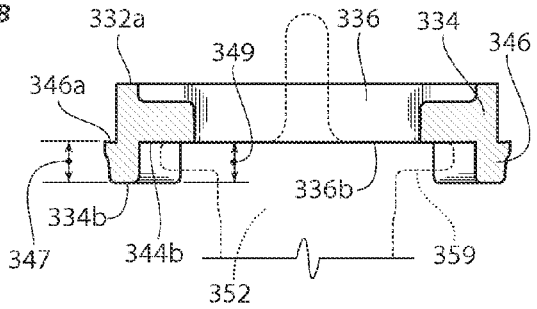
FIG. 10B is a cross-section view of the lock ring of FIG. 9, taken along lines 10B-10B of FIG. 10A.
Figure 11:
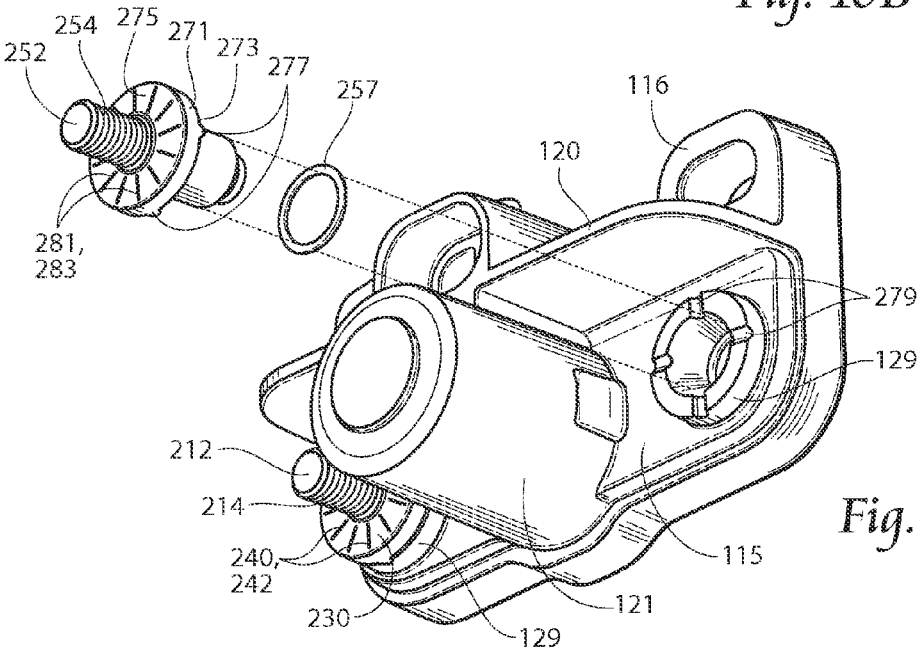
FIG. 11 is a perspective partial assembly view of the embodiment of FIG. 1.
Figure 12:
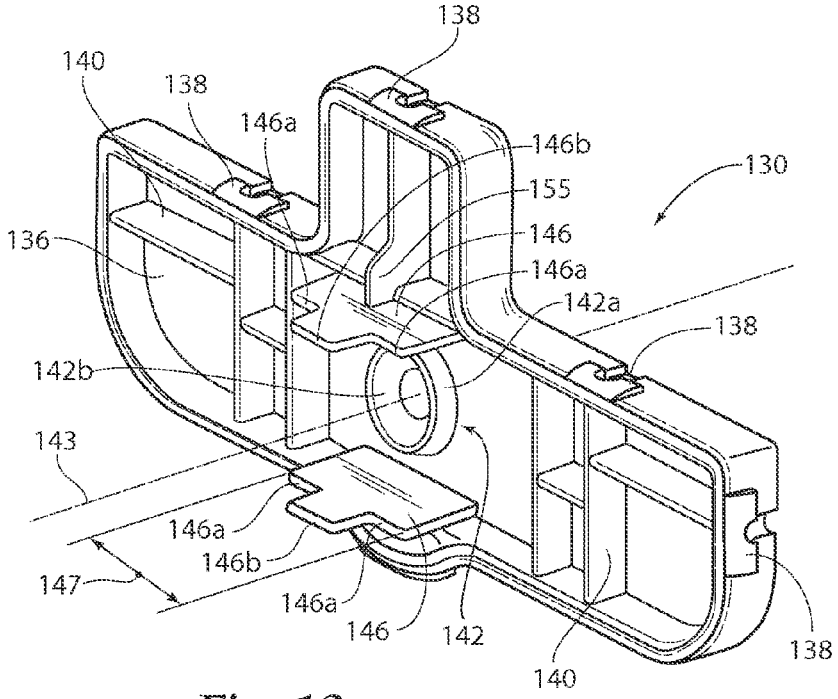
FIG. 12 is a perspective view of an embodiment of a housing cover portion according to the present invention.
Figure 13:
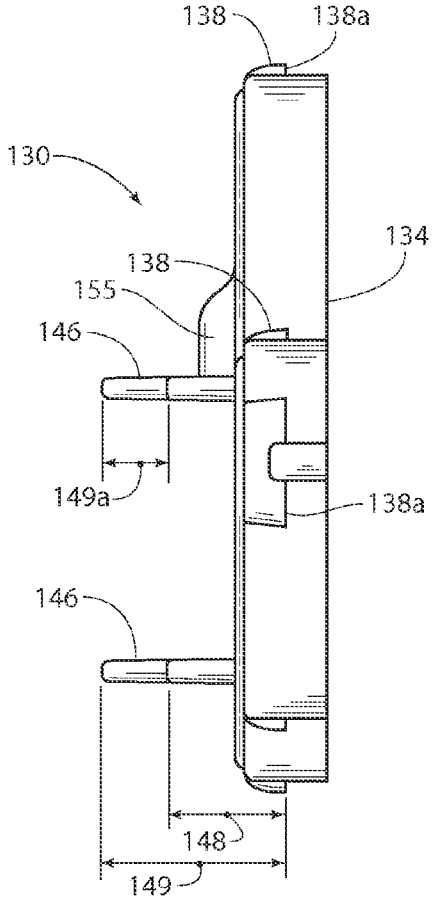
FIG. 13 is a right side elevation view of the embodiment of FIG. 12.
Figure 14:
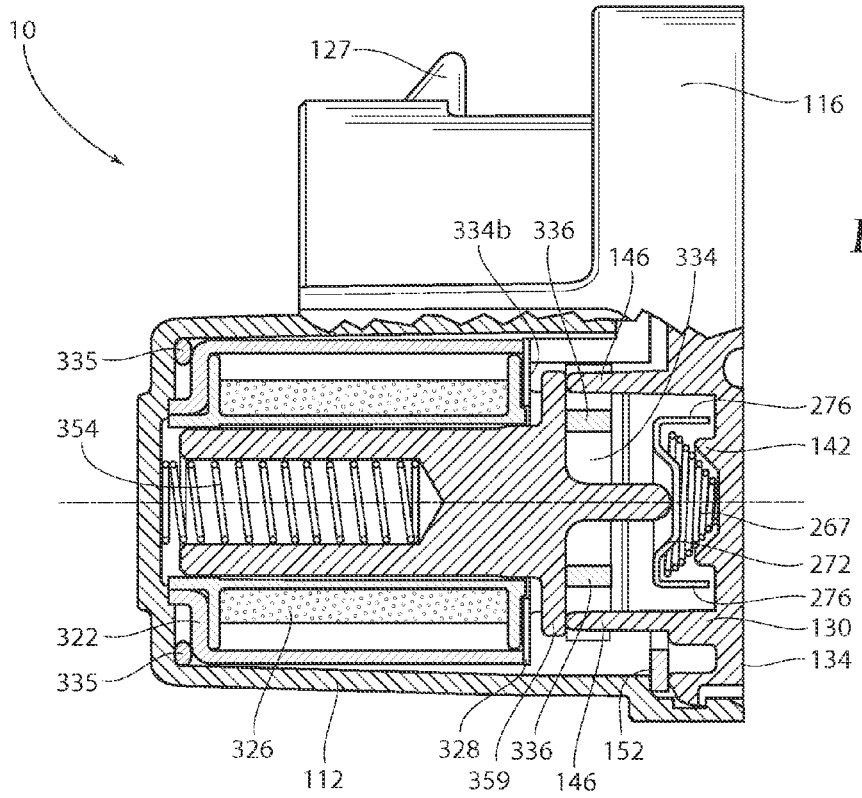
FIG. 14 is a partial cross-section right elevation view of the embodiment of FIG. 1.

The stationary coil assembly 320 may be provided with various retention means to maintain its position within the shroud 110, but a preferred mechanism is an actuator retention ring 330, preferably in concert with a resilient biasing member 335. The actuator retention ring 330 may be seen in greater detail in FIGS. 9 and 10. The actuator retention ring 330 is generally formed from a circumferential ring wall 332 surrounding an open central passage 333. The ring wall 332 is preferably substantially curviplanar, but having a plurality of diametrically opposed substantially convex portions 334 separated by a plurality of diametrically opposed substantially concave portions 336. The ring wall 332 has a preferably substantially planar top surface 332*a*. The retention ring 330 is preferably formed as a unitary member, where a majority of each convex portions 334 is provided at a first thickness 338 and the concave portions 336 are provided at a second thickness 340. Preferably, the second thickness 340 is less than the first thickness 338. Where each convex portion 334 is joined to a concave portion 336, a reinforcement post 342 may be formed. At least one, but preferably each, convex portion 334 is provided with a piston stop tab 344 extending radially inward and a ring mounting clip 346 extending radially outward from the ring wall 332. The piston stop tab 344 is provided with a bottom surface 344*b*, which is preferably substantially coplanar with a bottom surface 336*b* of the concave portions 336, which may be adapted to operate cooperatively to provide a stop surface for the stop flange 359 of the actuator 300. One or more convex portion 334 may be provided with a bottom surface 334*b*, which is adapted to rest against the cover washer 328 or the can 322 so as to limit the longitudinal motion of the actuator 300. The ring mounting clip 346 includes an engagement surface 346*a*, adapted to interface with a corresponding index surface 131*a* of a groove or notch 131 formed in the shroud 110. While the retention ring 330 may be formed from any suitable material, the ring 330 is preferably formed, such as by injection molding, using a desired material, such as a liquid crystal polymer material, which is preferably glass fiber reinforced. An example of such material is Vectra® E130i LCP material having about 30% glass reinforcement by weight, available from Polyplastics Co., Ltd., of Tokyo, Japan. A preferred material for the ring 330 will have a high flexural modulus, such as greater than 12,000 MPa, and more preferably about 15,000 MPa. A preferred material for the ring 330 will also have the ability to resist distortion when under a continuous load (high creep resistance). A retention ring 330 according to the present invention further assists in assembly of the contactor 10. For instance, when the ring 330 is to be inserted into the shroud 110, radially opposing forces may be applied to either the convex portions 334 or the concave portions 336. If the ring 330 were formed in a standard annular ring configuration, such radially opposite forces would result in an increased diameter of the ring in a direction substantially orthogonal to the forces. However, with the employ of the convex/concave surface combination, such radially opposing forces have the effect of reducing the diameter of the ring 330, thus easing insertion of the ring 330. As mentioned, the retention ring 330 works preferably in concert with a resilient biasing member 335. The biasing member 335 is preferably positioned in the actuator cavity 125, between the can 322 of the stationary coil assembly 320 and the shroud wall 112, thereby forcing the can 322 towards the retention ring 330. A preferred biasing member 335 is formed as a unitary member such as a nitrile (Buna N) 70 durometer o-ring of suitable diameter. The material diameter of the o-ring, that is the thickness of the o-ring, may be selected such that there is approximately 30% compression of same after installation of the can 322, the cover washer 328 and retention ring 330.

Returning back to FIG. 5, the movable plunger assembly 350 includes a plunger 352 and a resilient plunger biasing mechanism 354, which exerts force on the can 322 or most preferably on the shroud wall 112, and on the plunger 352. The plunger 352 extends between a bobbin end 353 and a contact end 355. Protruding into the plunger 352 from the bobbin end 353 is a reentrant bore 357. Coupled to or formed as a part of the plunger 352 is preferably a stop flange 359, which may be adapted to interface to the washer 328 at full retracted, or zero, stroke so as to minimize or prevent impact forces between the bobbin end 353 of the plunger 352 and can 322 or shroud wall 112. Alternatively, the bobbin end 353 of the plunger 352 could strike and rest against the shroud wall 112 and the stop flange 359 may also rest against the washer 328 or may be spaced therefrom. In this manner, the stop flange 359 acts as a clapper component in the magnetic circuit of the actuator 300. The biasing mechanism 354 preferably comprises a helical compression spring 356, which is inserted into the reentrant bore 357 in the plunger 352 and abuts the stationary coil assembly 320, or the shroud wall 112. The compression spring 356 has a spring constant of preferably about 2 pounds per inch (+/−10%), and the spring 356 may be formed from stainless steel or other suitable material such as music wire.

While various magnetically permeable materials may work, the can 322 is preferably formed from 20 gauge 1008 steel sheet material, deep drawn into a generally cylindrical shape having at least one open end. The bobbin 324 is preferably formed from a nylon 6,6 material which may include about thirty percent glass filler. The electrical conductor 326 is preferably a single strand of 28 gauge magnet wire wound around the bobbin 324 between about 300 turns and about 550 turns, and more preferably about 416 turns. The cover washer 328 is preferably formed from 25 gauge 1008 steel plate. The plunger 352 is preferably formed from steel, which may be cast, but is preferably machined as a single, unitary piece from a cold rolled steel, such as a 12L14 cold rolled steel bar stock having a nominal diameter of about ⅝ inches to form the stop flange 359.

During manufacturing, the retention ring 330 may control or minimize the effects of variations in the manufacturing of the actuator assembly 300. In other words, the stroke of the piston 352 is limited at zero stroke by the cover washer 328 and at full stroke by the bottom surface 336*b* of the retention ring 330 concave surfaces 336. If further limit force at full stroke is desirable, the tabs 146, previously described, may be used to contact a portion of the top surface 336*a* of the concave surfaces 336 and/or to contact the piston 352 directly. Regardless, it has been determined that the stroke of the piston 352 can be controlled through proper arrangement of the various reference surfaces of the retention ring 330. That is, because the contact assemblies 210,250 are fixed to the shroud 110 and the piston 352 must move relative to the shroud 110, it is desirable to provide a relatively consistent reference stop location for the piston 352. For example, starting with the engagement surface 346*a* of the mounting clip 346, it is known that such surface 346*a* is to cooperate with the corresponding index surface 131*a*. The index surface 131*a* is preferably stationary relative to the shroud 110. Design parameters of the retention ring 330 may be chosen based on a stop flange 359 of a predetermined or formed thickness, a desired stroke length, and relative positions of such features as one or more of: the index surface 131*a*, the stationary contact bar 220, the movable contact bar 260, the dampening stud 122, a fulcrum 124 about which the movable contact bar 260 may flex. For example, the bottom surface 334*b* of the convex portions 334 may be formed at a lock distance 347 to interface to the cover washer 328 or the can 322.

The bottom surfaces 336*b*,344*b* of the concave portions 336 and stop tabs 344, respectively, may be formed at a stroke distance 349 from the bottom surface 334*b* of the convex portion 334. The stroke length of the piston 352 may then be calculated or verified by subtracting the thickness of the stop flange 359, measured generally parallel to the plunger axis 352*a*, from the stroke distance 349. Any fine tuning adjustment that may be desirable may be performed by simple machining on the piston 352.

An embodiment of an electrical contactor according to the present invention may have several uses.

One use of the device is as an electrical contactor in a starter circuit on a motorized device, such as a lawn and garden tractor. In such an application, the first terminal 212 may be electrically coupled to a battery and the second terminal 252 may be electrically coupled to a terminal on a starter motor, or vice versa. Furthermore, the actuation control conductors 126 may be coupled to a control circuit (not shown) adapted to selectively apply a coil operating voltage, such as twelve volts, across the control conductors 126, for a desired period of time.

In its deactivated state, the plunger 352 may be said to be at full stroke, the biasing mechanism 354 forcing the contact end 355 of the plunger 352 against the actuator contact area 268 of the movable contact bar 260, thereby causing the bar 260 to flex against the movable-contact bias spring 267, spacing the second contact 266 from the first contact 226 by a desired contact gap 269, such as at least about 0.010 inches, and more preferably at least 0.016 inches. The full stroke of the piston 352 may be, for example, about 0.035 inches. When it is desired to bring the first contact 226 into electrical communication with the second contact 266, voltage may be applied to the electrical conductor 326 through the actuation control conductors 126, to which the conductor 326 is electrically coupled. Applying appropriate voltage will induce an electrical current through the conductor 326, which in turn induces a magnetic field that draws the plunger 352, against the force of the biasing mechanism 354, into the can 322, the plunger stop flange 359 abutting the washer 328 so as to nest the plunger 352 at zero stroke, thereby compressing the compression spring 356 for a total of preferably about half of its free length, or about 0.63 inches. That is, the compression spring 356 has a free (uncompressed and unstretched) length of about 1.25 inches. When the plunger 352 is at zero stroke, the compression spring 356 is preferably compressed to a length of about 0.620 inches, and when the plunger 352 is at full stroke, the compression spring 356 is preferably compressed to a length of about 0.655 inches. When the plunger 352 is at zero stroke, the contact end 355 is preferably spaced from the movable contact bar 260 by a minimum overtravel distance of at least 0.010 inches, but more preferably at least 0.018 inches. Such preferred spacing allows the plunger 352 to accelerate, on its way from zero stroke towards full stroke, prior to contacting the moveable contact bar 260.

Such increased velocity translates to a greater acceleration of the contact bar 260, and the mass of the plunger impact on the bar 260 is transferred to the contact 266 with the help of the reinforcing fins 276, aiding in an improved break.

Figure 8:
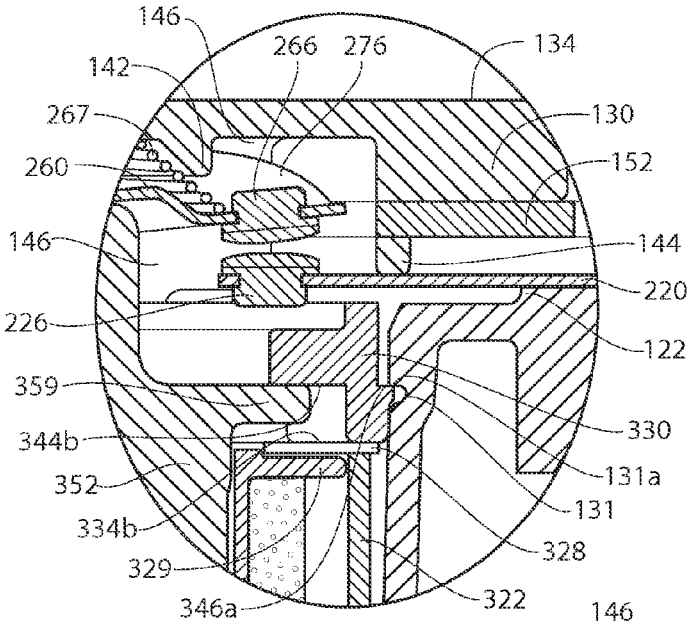
FIG. 8 is a magnified partial cross-section view of FIG. 5.
Figure 8A:
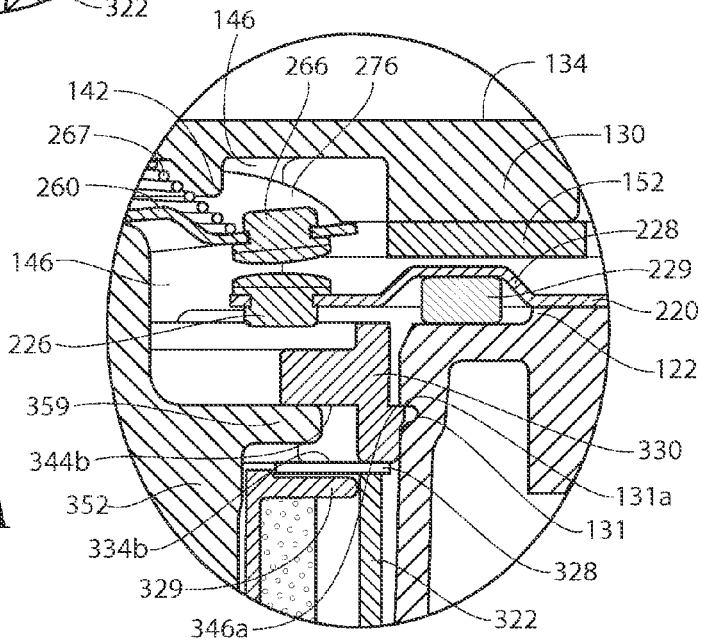
FIG. 8A is an alternative magnified partial cross-section view to that of FIG. 8.

During a full activation/deactivation cycle of the contactor 10, benefits are provided by various aspects of embodiments according to the present invention. Starting in a deactivated state, the plunger 352 is at full stroke, forcing the movable contact bar 260 towards the cover 130 against the force of the bias spring 267. The stationary contact bar 220 may be resting against the limit peg 144, if provided. When the actuator 300 is activated, the plunger 352 is drawn into the can 322, allowing the second contact 266 to touch the first contact 226. The stationary contact arm 220 is allowed to flex about the dampening stud 122, thereby allowing a deceleration of the second contact 266 against the first 226, helping to prevent bounce. An electrical path is then provided between the first terminal 212 and the second terminal 252, through the stationary contact bar 220, the first contact 226, the second contact, and the movable contact bar 260. When the actuator 300 is deactivated, the plunger 352 is forced by the plunger biasing mechanism 354 against the movable contact bar 260 to overcome the bias of the movable-contact bias spring 267. As the contacts 226,266 move, the stationary contact bar 220 may be forced against the stationary limit peg 144, thereby permitting a clean break of the electrical connection previously provided. In a preferred embodiment, the limit peg 144 is located closer to the first contact 226 than the dampening stud 122. That is, an effective flexing length of the stationary contact arm 220 is different whether the connection is being made or broken. In other words, during activation, a moment arm having a first effective flexing length 220*a* is created by the stationary contact arm 220 between the first contact 226 and the dampening stud 122. The length 220*a* of such arm will allow the stationary contact arm 220 to flex or deflect during the making of an electrical connection between the first contact 226 and the second contact 266. During deactivation, if the limit peg 144 is closer to the first contact 226 than the dampening stud 122, a shorter moment arm having a second effective flexing length 220*b* is created between the first contact 226 and the limit peg 144. While the shorter moment arm may allow some flexing of the stationary contact bar 220 during the break action, the shorter arm will flex less than the longer moment arm created during activation. Thus, such contactor 10 may be said to have a soft make and a hard break. If the limit peg 144 is not provided, then the resiliency of the stationary contact bar 220 may be relied upon. If further resistance to movement of the stationary contact bar 220 is desirable, a dimple 228 similar to that 272 on the moveable contact bar 260 may be formed into the stationary bar 220 to stiffen the bar 220. Such rigidity added by, e.g., the dimple 228, may also be required for certain use conditions, such as where the contactor is exposed to high impact forces that may otherwise deform the contact bar 220. Additionally or alternatively, a stationary contact biasing member 229 such as a spring or elastomer material could be placed between the stationary bar 220 and the shroud wall 112 on one or more sides of the stationary bar 220. Such alternative embodiments can be seen in FIG. 8A.

Also, near zero stroke, plunger acceleration has been decreased by the design of the cover washer 328.

Figure 15:
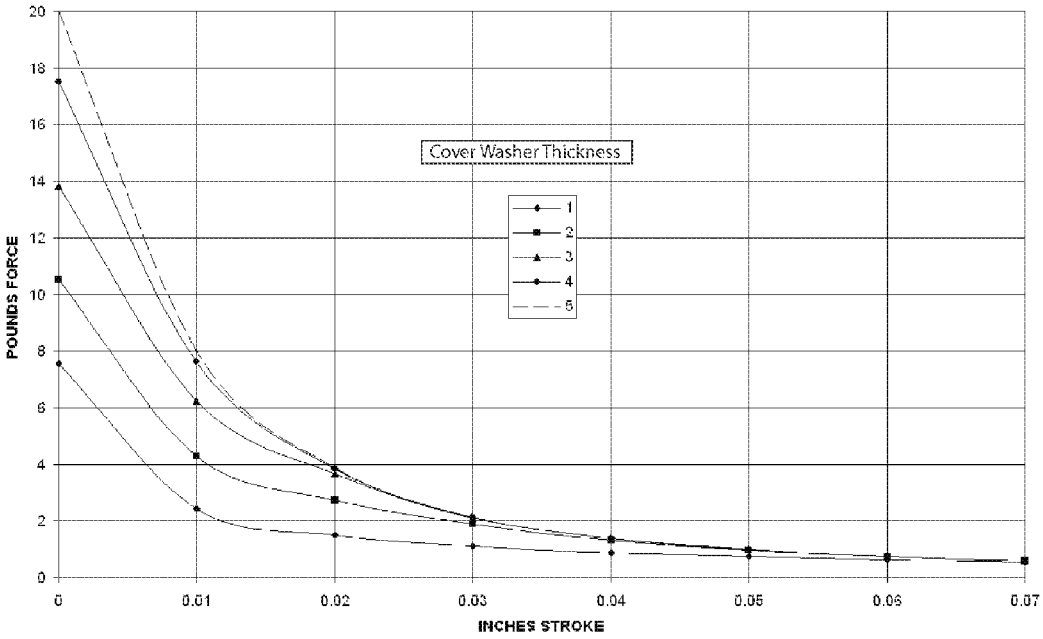
FIG. 15 is a graph of force versus stroke distance for a given electromagnetic coil with cover washers of various thicknesses.

That is, as can be seen in FIG. 15, the thickness of the cover washer 328 is likely to play a role in the acceleration of the plunger 352 towards zero stroke. That is, the thinner the cover washer 328 (decreasing number), the quicker the washer 328 magnetically saturates, thereby preventing extreme acceleration of the plunger 352 near zero stroke. Stated conversely, the thicker the washer 328 (increasing number), the higher the resulting zero stroke pull force, thereby leading to an increased near zero stroke acceleration. The thickness of the cover washer 328 can be chosen to achieve the near zero stroke acceleration that is desirable. In the preferred embodiment, the pull force at zero stroke has been selected to be approximately 2.5 pounds, or line number 2 in FIG. 15. Thus, the decreased near zero stroke acceleration helps to reduce bounce even when contacts 226,266 become worn.

When it is desirable to prevent electrical communication between the first contact 226 and the second contact 266, the voltage applied to the actuation control conductors 126 is removed, thereby allowing the biasing mechanism 354 to force the plunger 352 longitudinally outward, causing the contact end 355 to engage the actuator contact area 268 of the movable contact bar 260 and flex the contact bar 260 away from the stationary contact bar 320 so as to break the electrical communication between the contacts 226,266.

Figure 16:
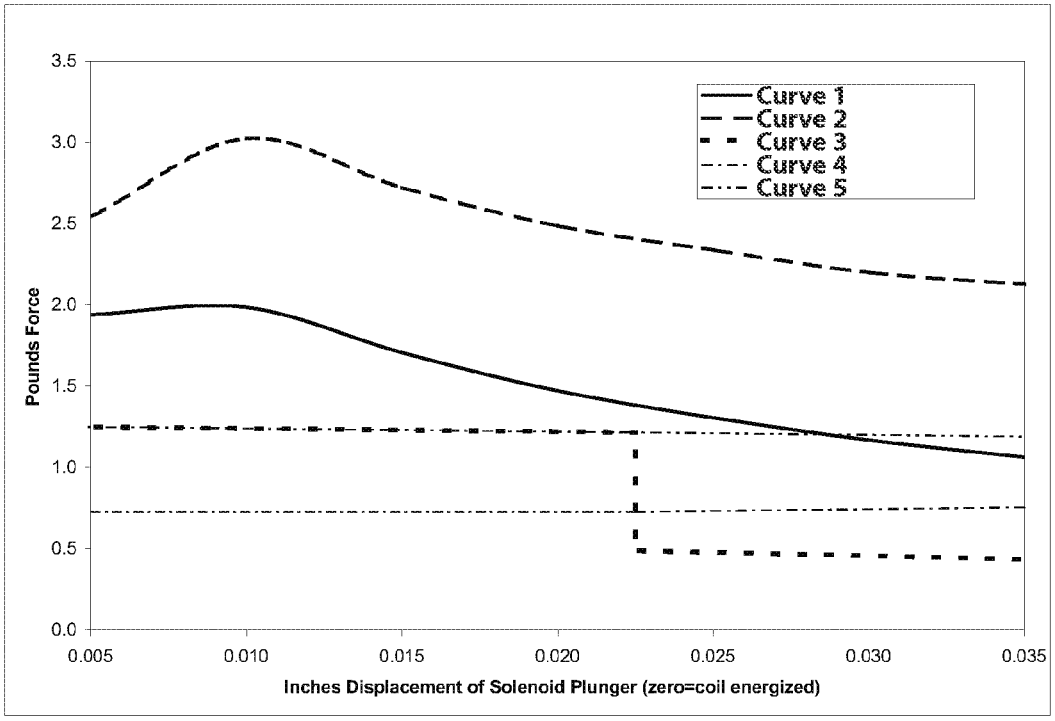
FIG. 16 is a graph comparing pounds of force at various stroke positions of an embodiment of a contactor according to the present invention.

Turning now to FIG. 16, a series of forces are depicted relative to the stroke distance of the plunger 352, when in use. Curve 1 represents the pull force to be applied to the plunger 352 by the solenoid 310 with six volts applied across the conductor 326. Curve 2 represents the pull force to be applied to the plunger 352 by the solenoid 310 with twelve volts applied across the conductor 326. Curve 3 is a load curve represents the force required to move the plunger 352. Curve 4 represents the force being applied by the movable-contact bias spring 267. Curve 5 represents the force applied by the plunger biasing mechanism 354. Since the forces represented by curves 4 and 5 are operating in opposite directions on the plunger 352 when the plunger 352 is in contact with the movable contact bar 260, the load curve (curve 3) equals curve 5 minus curve 4 while the plunger is in contact with the movable contact bar 260.

At zero stroke, when the stop flange 359 is seated against the cover washer 328, the solenoid is energized, and the plunger bias spring 356 is compressed. Thus, the load that the solenoid 310 must overcome is only that of the bias spring 356. When the solenoid 310 is de-energized, the plunger 352 will begin its travel towards the movable contact bar 260. Once the plunger 352 touches the movable contact bar 260, it will be pushing the bar 260 against the bias force of the movable-contact bias spring 267, until the plunger 352 reaches full stroke, which is preferably the point where the stop flange 359 is seated against the retention ring 330. While the plunger 352 is in contact with the moveable contact bar 260, any required force to withdraw the plunger 352 (curve 3) is decreased by the force provided by the movable-contact bias spring 267.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. An electrical contactor comprising:

a housing;

an electrical conductor assembly at least partially within the housing, the electrical conductor assembly including a stationary contact assembly and a movable contact assembly; and a contact actuator operably interfaced with the electrical conductor assembly, the contact actuator including a plunger movable from a first plunger position in contact with the movable contact assembly to a second plunger position spaced from the movable contact assembly, wherein translation of the plunger is limited by a stop flange provided thereon, wherein the contact actuator further comprises an electromagnetic solenoid assembly comprising:

a movable plunger assembly comprising the plunger extending between a first contact end and a second bobbin end, and a plunger biasing mechanism configured to bias the plunger towards the movable contact assembly, a stationary coil assembly comprising a substantially cylindrical can having an open washer end, a bobbin situated substantially within the can, a plurality of turns of electrical conductor disposed around the bobbin, and a magnetically permeable cover washer configured to rest against the open washer end, wherein the stationary contact assembly defines a first electrically conductive path from a first electrical contact to a first terminal, the first electrical contact located within the housing and the first terminal extending through the housing, further wherein the movable contact assembly defines a second electrically conductive path from a second electrical contact to a second terminal, the second electrical contact located within the housing and the second terminal extending through the housing, and further wherein, when the plunger is in the second plunger position, a third electrically conductive path is defined from the first terminal to the second terminal.

2. An electrical contactor according to claim 1, wherein the cover washer is C-shaped.

3. An electrical contactor according to claim 1 further comprising a retention mechanism adapted to maintain the stationary coil assembly in a substantially stable relationship with the housing.

4. An electrical contactor according to claim 3, wherein when the plunger is in the first plunger position, the stop flange rests against the retention mechanism, and when the plunger is in the second plunger position, the stop flange rests against the cover washer.

5. An electrical contactor according to claim 3, wherein the retention mechanism comprises a retention ring adapted to contact the housing and the cover washer.

6. An electrical contactor according to claim 5, wherein the retention mechanism further comprises a resilient biasing member compressed between the can and the housing, wherein the biasing member forces the can towards the cover washer.

7. An electrical contactor according to claim 6, wherein the resilient biasing member is a nitrile o-ring.

8. An electrical contactor according to claim 1, wherein when the electromagnetic solenoid assembly is de-energized, the plunger biasing mechanism forces the plunger contact end against the second contact member thereby causing the second contact to disengage from the first contact, and further wherein, when the electromagnetic solenoid assembly is energized, the second electrical contact is allowed to travel toward and engage with the first electrical contact.

9. An electrical contactor according to claim 1, wherein the plunger includes a reentrant bore formed into the second bobbin end and the plunger biasing mechanism is a coiled spring inserted at least partially into the reentrant bore.

10. An electrical contactor comprising:

a housing;

an electrical conductor assembly at least partially within the housing, the electrical conductor assembly including a stationary contact assembly and a movable contact assembly; and a contact actuator operably interfaced with the electrical conductor assembly, the contact actuator including a plunger movable from a first plunger position in contact with the movable contact assembly to a second plunger position spaced from the movable contact assembly, wherein translation of the plunger is limited by a stop flange provided thereon, wherein the stationary contact assembly defines a first electrically conductive path from a first electrical contact to a first terminal, the first electrical contact located within the housing and the first terminal extending through the housing, further wherein the movable contact assembly defines a second electrically conductive path from a second electrical contact to a second terminal, the second electrical contact located within the housing and the second terminal extending through the housing, further wherein, when the plunger is in the second plunger position, a third electrically conductive path is defined from the first terminal to the second terminal, and further wherein the movable contact assembly includes an electrically conductive contact bar supporting the second contact and a contact bias member disposed between the contact bar and the housing, the contact bias member applying force to the contact bar to bias the second contact towards the first contact, wherein the contact bias member is a coiled, frustoconical spring member.

11. An electrical contactor according to claim 10, the spring member including a base coil lying circumjacent to a protrusion formed on the contact bar.

12. An electrical contactor according to claim 11, wherein the protrusion is formed by a dimple integrally disposed with the contact bar.

13. An electrical contactor comprising:

a housing including a shroud wall defining a cavity;

a cover mateable with the shroud wall along a seam; and a waterproof gasket disposed between the shroud wall and the cover;

an electrical conductor assembly at least partially within the housing, the electrical conductor assembly including a first contact assembly including a first electrically conductive terminal extending through the shroud wall;

a first electrically conductive contact member mounted within the housing and in electrical communication with the first terminal, the first electrically conductive contact member having a free end and an electrical contact located closer to the free end than to the first terminal;

a second contact assembly including a second terminal extending through the shroud wall;

a second electrically conductive contact member mounted within the housing and in electrical communication with the second terminal, the second electrically conductive contact member biased towards the first contact member and having a free end and an electrical contact located closer to the free end than to the second terminal;

wherein the first contact member and the second contact member are arranged in a partially overlapping relationship along an overlap length, wherein the first electrical contact has a contact surface facing the second contact member and the second electrical contact has a contact surface facing the first contact member; and a contact actuator operably interfaced with the electrical conductor assembly, the contact actuator including an electromagnetic solenoid assembly including a movable plunger assembly comprising a plunger extending between a first contact end and a second bobbin end, and a plunger biasing mechanism configured to bias the plunger towards the second contact member, a stationary coil assembly comprising a substantially cylindrical can having an open washer end, a bobbin situated substantially within the can, a plurality of turns of electrical conductor disposed around the bobbin, and a cover washer configured to rest against the open washer end;

a retention mechanism adapted to maintain the stationary coil assembly in a substantially stable relationship with the housing, wherein when the electromagnetic solenoid assembly is de-energized, the plunger biasing mechanism forces the plunger contact end against the second contact member thereby causing the second contact to disengage from the first contact, and further wherein, when the electromagnetic solenoid assembly is energized, the second electrical contact is allowed to travel toward engage with the first electrical contact.

14. A method of allowing an electrical connection to be made between two electrically conductive terminals, the method comprising the steps of:

providing a contact actuator operably interfaced with an electrical conductor assembly having a first electrical contact and a second electrical contact, the contact actuator comprising:

a plunger movable from a first plunger position in contact with a movable contact assembly to a second plunger position spaced from the movable contact assembly, wherein translation of the plunger is limited by a stop flange provided thereon; and a stationary coil assembly comprising a substantially cylindrical can having an open washer end, a bobbin situated substantially within the can, a plurality of turns of electrical conductor disposed around the bobbin, and a magnetically permeable cover washer configured to rest against the open washer end;

placing a voltage differential across the electrical conductor to draw the stop flange towards the cover washer;

controlling a terminal velocity of the plunger by substantially magnetically saturating the cover washer with a magnetic field caused by electrical current flow through the electrical conductor; and after substantially magnetically saturating the cover washer, allowing the plunger to reach a mechanical end of travel in the second plunger position.

15. A method according to claim 14, wherein the mechanical end of travel is defined by seating the stop flange against the cover washer so as to space the plunger from the movable contact assembly.

16. A method according to claim 14, wherein the first electrical contact is provided on a stationary contact assembly comprising:

a first cantilevered electrically conductive contact bar extending between a mounting end and free end, the first electrical contact provided closer to the free end than the mounting end.

17. A method according to claim 16, wherein the second electrical contact is provided on a movable contact assembly comprising:

a second cantilevered electrically conductive contact bar extending between a mounting end and a free end that at least partially overlaps the free end of the first contact bar, the second electrical contact provided closer to the free end than the mounting end; and when the plunger is in the first plunger position, the plunger is in contact with the second contact bar at a contact area between the second contact and the mounting end of the second contact bar.

18. A method according to claim 17, wherein the contact area is closer to the free end of the second contact bar and closer to the second contact than the contact area is with respect to the mounting end of the second contact bar.

19. A method according to claim 17, wherein the first contact bar extends for a first contact bar length between its mounting end and free end, and the second contact bar extends for a second contact bar length between its mounting end and free end, the first contact bar length being shorter than the second contact bar length.

20. A method according to claim 15, wherein when the plunger is seated against the cover washer and the second contact is engaged with the first contact, the first contact bar is deflected by a force exerted on the first contact by the second contact.

21. A method according to claim 14 further comprising the steps of:

removing the voltage differential from the electrical conductor;

forcing the plunger towards the second contact bar;

striking the second contact bar with the plunger after allowing the plunger to travel some distance spaced from the second contact bar; and separating the second electrical contact from the first electrical contact.

22. A method according to claim 21, wherein the separating step comprises the step of breaking a weld formed between the first electrical contact and the second electrical contact.

23. An electrical contactor including a solenoid assembly, the solenoid assembly comprising:

a movable plunger assembly comprising a plunger extending between a first contact end and a second bobbin end, the plunger being longitudinally movable from a first plunger position in contact with a movable contact assembly to a second plunger position spaced from the movable contact assembly, wherein translation of the plunger is limited by a stop flange provided thereon; and a stationary coil assembly comprising, a substantially cylindrical can extending between an open washer end and a bobbin end, the can comprising, an aperture formed through the bobbin end, and a collar disposed around the aperture;

a bobbin situated substantially within the can; and a plurality of turns of electrical conductor disposed around the bobbin, wherein the bobbin end of the plunger extends into the aperture.

24. An electrical contactor according to claim 23, further comprising a magnetically permeable cover washer configured to rest against the open washer end.

25. An electrical contactor according to claim 23, wherein the bobbin end of the plunger extends into the aperture when the plunger is in the first plunger position and when the plunger is in the second plunger position.

* * * * *